US011209152B2

(12) United States Patent
Sharrah

(10) Patent No.: US 11,209,152 B2
(45) Date of Patent: Dec. 28, 2021

(54) LIGHTING DEVICE WITH SEALED COMPARTMENTS

(71) Applicant: Streamlight, Inc., Eagleville, PA (US)

(72) Inventor: Jonathan R. Sharrah, Phoenixville, PA (US)

(73) Assignee: Streamlight, LLC, Eagleville, PA (US)

( * ) Notice: Subject to any disclaimer, the term of this patent is extended or adjusted under 35 U.S.C. 154(b) by 0 days.

(21) Appl. No.: 16/747,784

(22) Filed: Jan. 21, 2020

(65) Prior Publication Data

US 2020/0232634 A1 Jul. 23, 2020

Related U.S. Application Data

(60) Provisional application No. 62/794,986, filed on Jan. 21, 2019, provisional application No. 62/795,149, filed on Jan. 22, 2019.

(51) Int. Cl.

| | |
|---|---|
| ***F21V 31/00*** | (2006.01) |
| ***F21V 29/74*** | (2015.01) |
| ***F21L 4/08*** | (2006.01) |
| ***F21L 14/00*** | (2006.01) |

(52) U.S. Cl.

CPC ..... *F21V 29/74* (2015.01); *F21L 4/08* (2013.01); *F21L 14/00* (2013.01); *F21V 31/005* (2013.01)

(58) Field of Classification Search

CPC ..... F21V 29/74; F21V 31/005; F21L 4/08

See application file for complete search history.

(56) References Cited

U.S. PATENT DOCUMENTS

| | | | | |
|---|---|---|---|---|
| 8,911,116 | B2 | 12/2014 | Blincoe et al. | |
| 2016/0330825 | A1* | 11/2016 | Recker | H05B 45/20 |

FOREIGN PATENT DOCUMENTS

| | | | | |
|---|---|---|---|---|
| CN | 203322895 | U | | 12/2013 |
| CN | 206488254 | U | | 9/2017 |
| JP | 2017174675 | A | * | 9/2017 |
| JP | 2017174675 | A | | 9/2017 |
| KR | 101322468 | B1 | | 10/2013 |

OTHER PUBLICATIONS

International Search Report and Written Opinion of the International Searching Authority from corresponding PCT Application No. PCT/US2020/014348, dated May 25, 2020 (11 pages).

* cited by examiner

*Primary Examiner* — Karabi Guharay

(74) *Attorney, Agent, or Firm* — Quarles & Brady LLP; James J. Aquilina

(57) ABSTRACT

A lighting device having separate compartments for its electronics components and heatsink is disclosed. In some embodiments, the lighting device has a waterproof electronics compartment that extends at least partially through the heatsink.

11 Claims, 13 Drawing Sheets

LIGHTING DEVICE WITH SEALED COMPARTMENTS

FIELD OF THE DISCLOSURE

The present disclosure relates to the field of lighting devices, and more particularly to a portable lighting device for use as a "scene" light at, for example, worksites and emergency scenes.

BACKGROUND

Portable scene lights having positional adjustability are known in the art. One example of a portable scene light is the "Portable Scene Light" manufactured by Streamlight, Inc. of Eagleville, Pa., U.S.A., which is the applicant of the present application.

Known portable scene lights lack compartmentalized chambers for housing the various sub-assemblies of the light to provide appropriate heat-dissipation and waterproofing features. Accordingly, there is a need for improved lighting devices that overcome these and other drawbacks of the prior art devices.

BRIEF DESCRIPTION OF THE DRAWINGS

The lighting device according to the present disclosure is further described with reference to the accompanying drawings, in which.

SUMMARY OF THE INVENTIVE CONCEPTS

Figure 1:
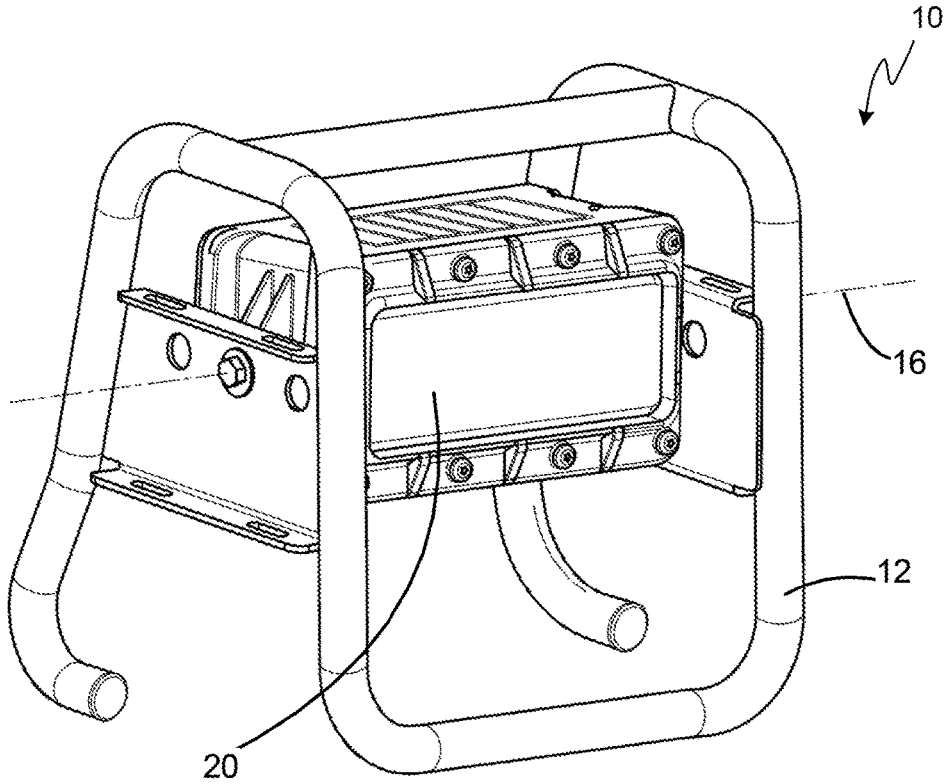
FIG. 1 is a front perspective view of an embodiment of a lighting device according to the present disclosure.

In one respect the inventive concept is a lighting device comprising: at least one light located in a first compartment, the first compartment being waterproof; at least one power source operably connected to the at least one light to supply power thereto, the at least one power source located in a second compartment, the second compartment being waterproof; a heatsink located adjacent to the at least one light, the heatsink being at least partially external to each of the first compartment and the second compartment, wherein the heatsink is located at least partially between the first and second compartments.

In another respect the inventive concept is a lighting device comprising a housing, the housing including: at least one light; at least one power source operably connected to the at least one light to supply power thereto; a heatsink compartment containing at least one heatsink, the at least one heatsink having six sides, the heatsink compartment completely enveloping the at least one heatsink on at least four of its six sides; and an electronics compartment that is separate from the heatsink compartment, the electronics compartment containing the at least one power source, the electronics compartment being waterproof; wherein the heatsink compartment is located at least partially between the at least one light and the electronics compartment.

DETAILED DESCRIPTION

The ensuing detailed description provides exemplary embodiment(s) only, and is not intended to limit the scope, applicability, or configuration of the herein disclosed embodiment(s). Rather, the ensuing detailed description of the exemplary embodiment(s) will provide those skilled in the art with an enabling description for implementing the exemplary embodiments in accordance with the present disclosure. It should be understood that various changes may be made in the function and arrangement of elements without departing from the spirit and scope of the invention, as set forth in the appended claims.

To aid in describing the disclosure and/or invention as claimed, directional terms may be used in the specification and claims to describe portions of the present disclosure and/or invention (e.g., upper, lower, left, right, etc.). These directional definitions are merely intended to assist in describing the embodiment(s) and claiming the invention, and are not intended to limit the disclosure or claimed invention in any way. In addition, reference numerals that are introduced in the specification in association with a drawing figure may be repeated in one or more subsequent figures without additional description in the specification, in order to provide context for other features.

It should be understood that when an element is referred to herein as being "connected" or "coupled" to another element, it can be integral with the other element, directly connected or coupled to the other element, or that intervening elements may be present. In contrast, when an element is referred to as being "directly connected" or "directly coupled" to another element, it should be understood that no intervening elements are present. Other words used to describe the relationship between elements should be interpreted in a like fashion (e.g., "between" versus "directly between," "adjacent" versus "directly adjacent," etc.).

In embodiments described herein or shown in the drawings, any direct electrical connection or coupling, i.e., any connection or coupling without additional intervening elements, may also be implemented by an indirect connection or coupling, i.e., a connection or coupling with one or more additional intervening elements, or vice versa, as long as the general purpose of the connection or coupling, for example, to transmit a certain kind of signal or to transmit a certain kind of information, is essentially maintained. Features from different embodiments may be combined to form further embodiments. For example, variations or modifications described with respect to one of the embodiments may also be applicable to other embodiments, unless noted to the contrary.

In applications in which it is desirable or necessary to illuminate a scene, for example a work or accident scene, a portable light that is capable of multiple free-standing or mounted positions may be an effective tool. It is the desire of Applicant to disclose a portable scene light that incorporates several improvements over the prior art.

Referring generally to the Figures, an embodiment of a lighting device 10 in accordance with the present disclosure will be described in detail. The lighting device 10 comprises a light head 20 that is rotatably attached via mounts 24*a*,24*b* to a frame 12 about an axis of rotation 16. U.S. patent application Ser. No. 16/251,400, filed Jan. 18, 2019, the entire contents of which are incorporated by reference herein, discloses further aspects of the frame 12 of the lighting device 10 according to the present disclosure.

In this embodiment, the light head 20 has a housing 22 that contains a space that serves as a heatsink assembly compartment 30, a plurality of vents 32 located on the top side of the housing 22, and a plurality of vents 34 located on the bottom side of the housing 22. The vents 32,34 allow heat from a heatsink assembly 70 to escape from the housing 22 of the light head 20, thus preventing the light head 20 from overheating.

Unlike many prior art products, the light head 20 according to the present disclosure is compartmentalized so that the lights (in this embodiment, LEDs 88) are located in a waterproof compartment that is separate from the compartment that contains the heatsink assembly 70, and the electronics of the device (which include the battery packs 106*a*,106*b* and driver assembly 120 for the LEDs) are located in another compartment that is also waterproof. This arrangement separates the heat dissipated by the heatsink assembly 70 from the electronic components of the light head 20, thus protecting the sensitive electronic components from overheating, while also locating the electronic components in a sealed, waterproof compartment that protects these components from environmental damage while the light head 20 is used outdoors or in wet conditions. In the present embodiment, the compartments that contain, respectively, the lights and the electronics (including the power source(s)) are connected together via a pair of wire passages to form a continuous, waterproof volume or compartment, although in alternative embodiments these two compartments could be sealed or closed off with respect to each other, using one or more waterproof passthroughs therebetween for continuous wire passage between the two compartments, or waterproof wire connector(s) that provide a waterproof seal but allow for electrical signals to be sent through the connector(s) between the two compartments.

In the present embodiment, a front cover 40 is placed atop a lens 52, a reflector 60, and a front block 72 of the heatsink assembly 70 and is affixed to the housing 22 by a set of fasteners (in this embodiment eight, but only one fastener 44 is labeled in the Figures for ease of illustration) that are each passed through a respective fastener hole (in this embodiment eight, but only one fastener hole 42 is labeled in the Figures for ease of illustration) located in the front cover 40 and into to a respective fastener hole (not labeled) located within the housing 22. In this embodiment, the fastener holes in the housing 22 for attaching the front cover 40 are of smooth-bore type having a deformable plastic material therein, and the fasteners (including fastener 44) are of thread-forming type so that each of the fasteners (including fastener 44) forms its own threads within the respective hole when advanced therein. A lens seal 56 is placed and compressed between an outer rim 54 of the lens 52 and a front surface of the front block 72 of the heatsink assembly 70 to provide the assembly of the front cover 40 with a waterproof seal.

Figure 2:
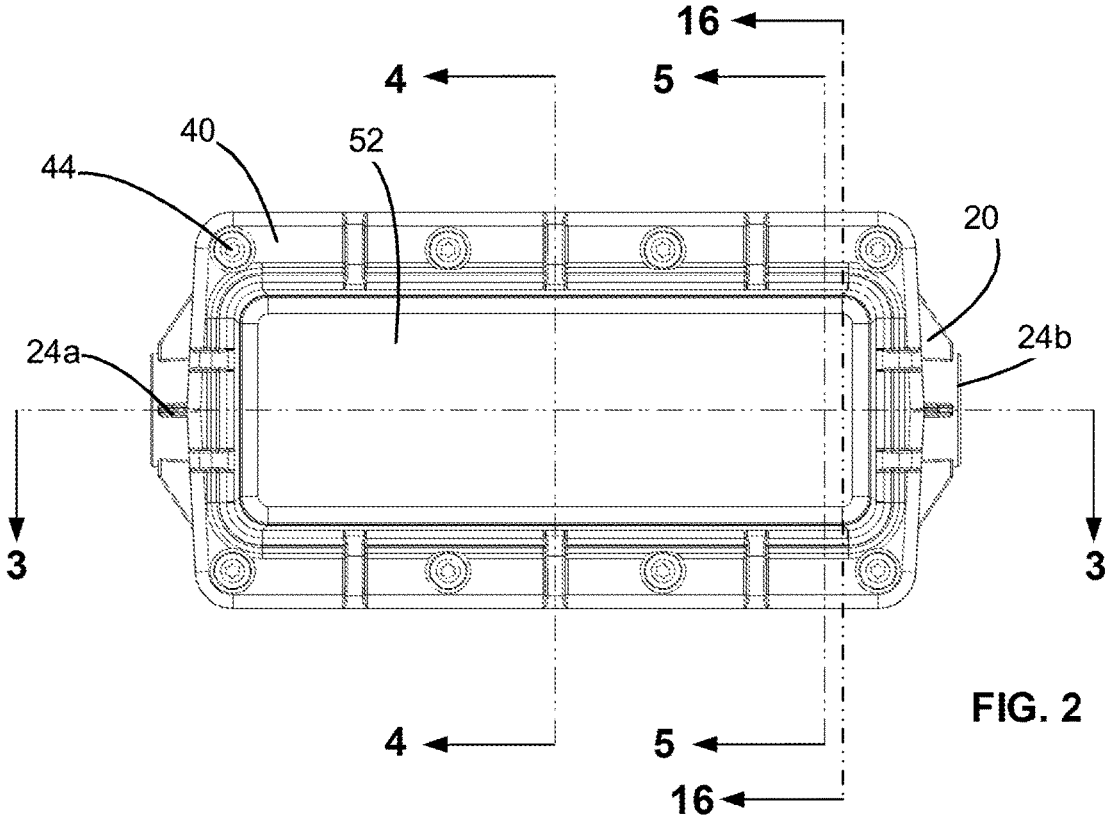
FIG. 2 is a front view of a light head thereof.
Figure 3:
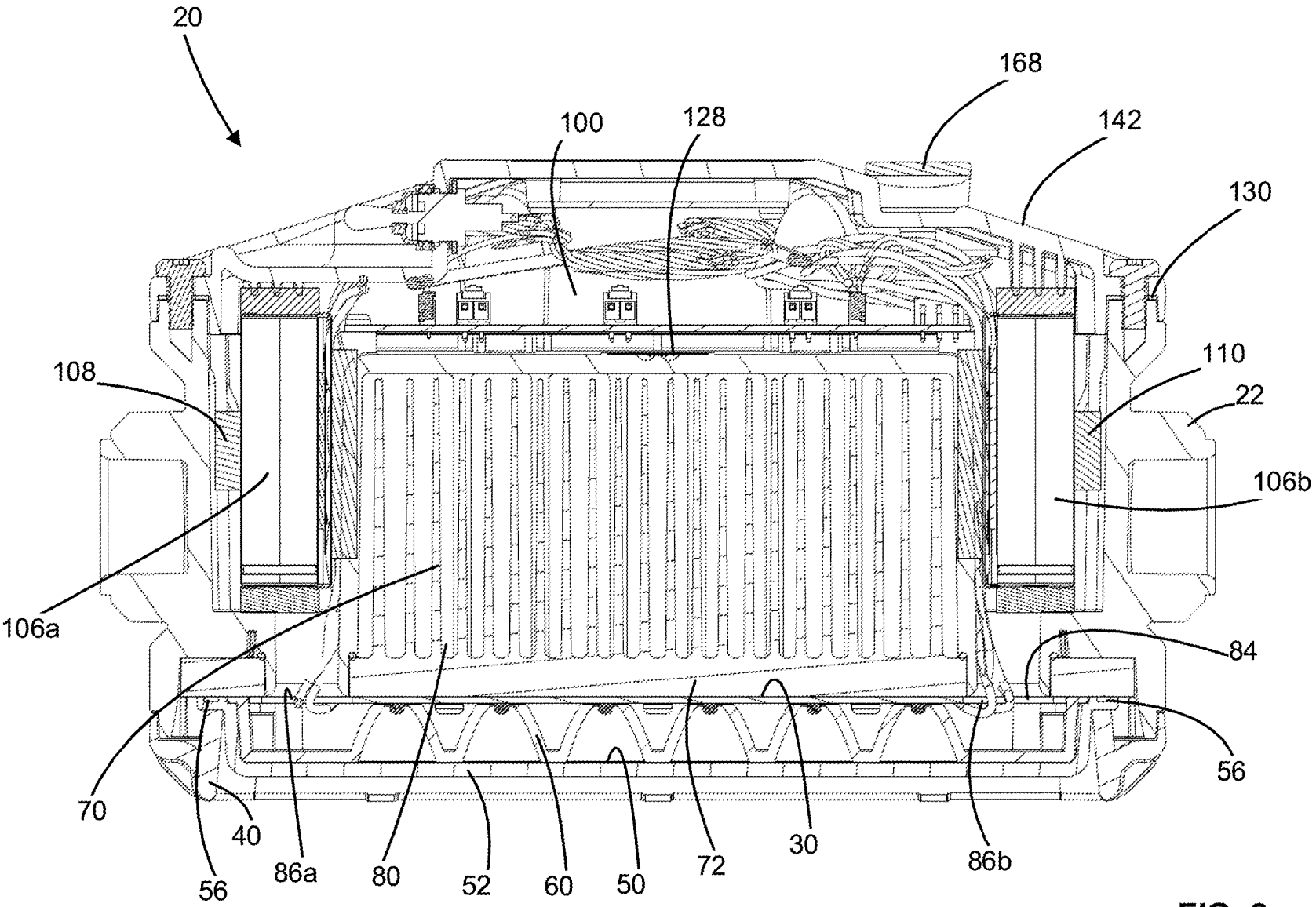
FIG. 3 is an enlarged sectional view taken along line 3-3 of FIG. 2.
Figure 4:
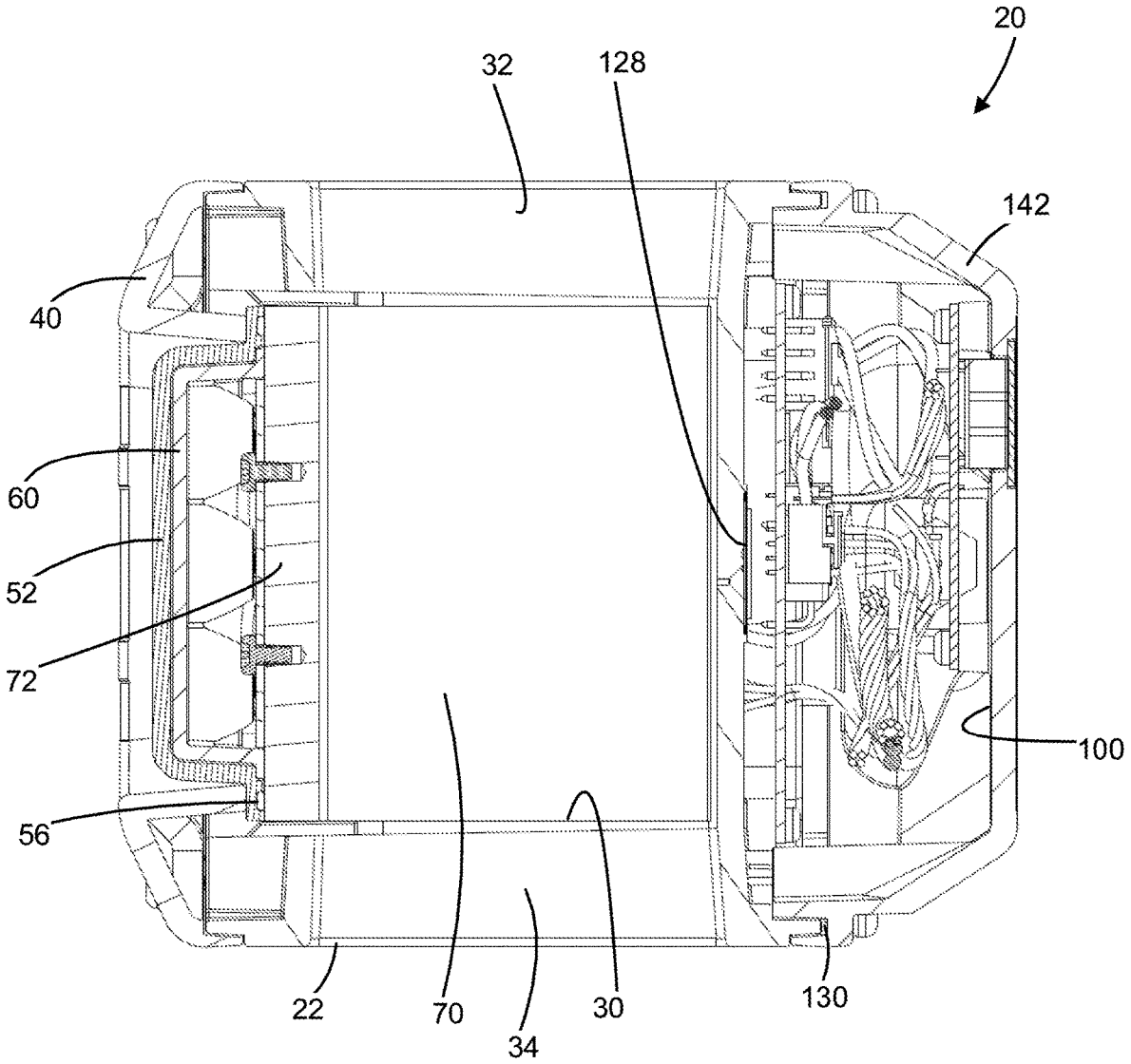
FIG. 4 is an enlarged sectional view taken along line 4-4 of FIG. 2.
Figure 5:
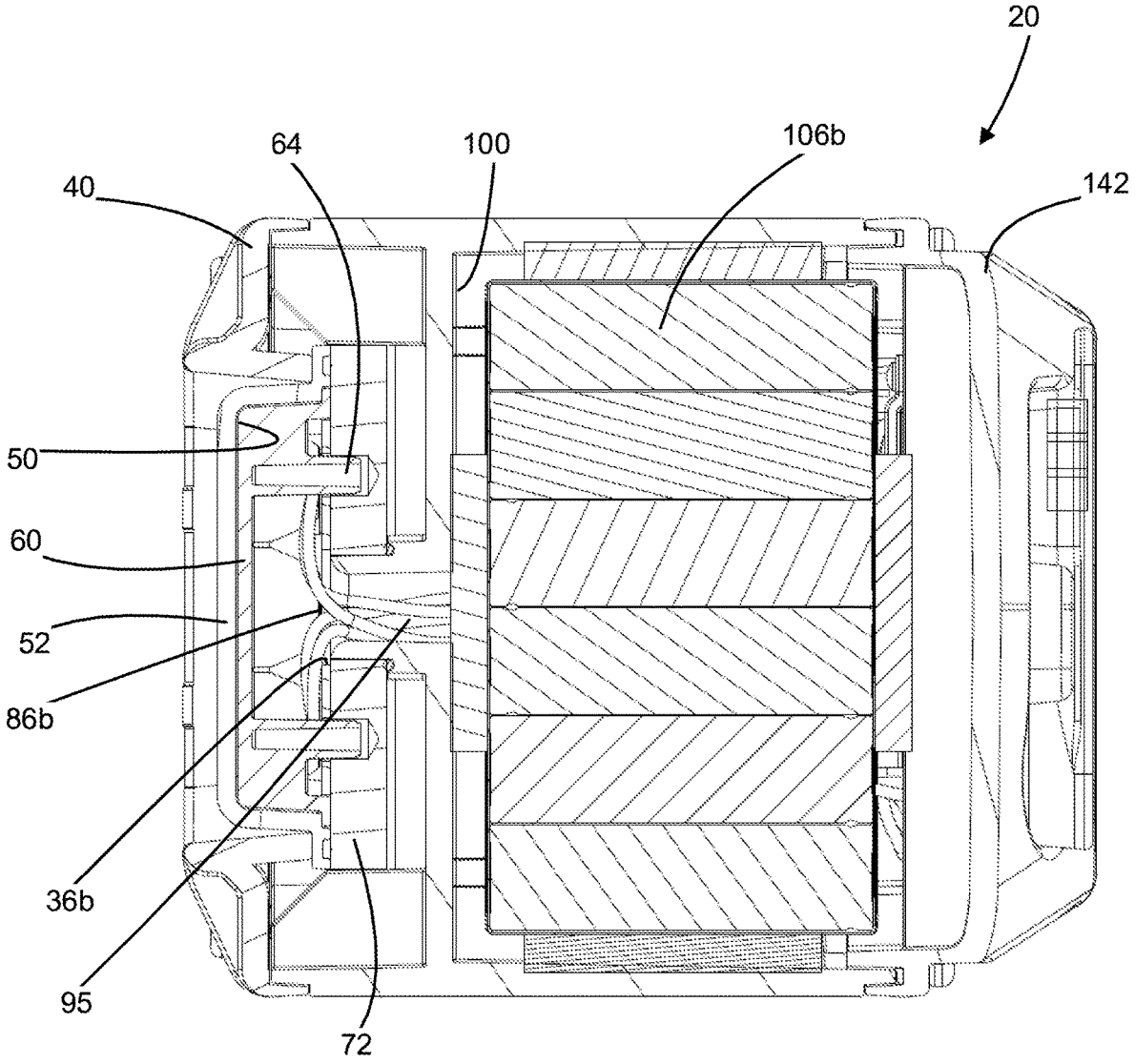
FIG. 5 is an enlarged sectional view taken along line 5-5 of FIG. 2.
Figure 6:
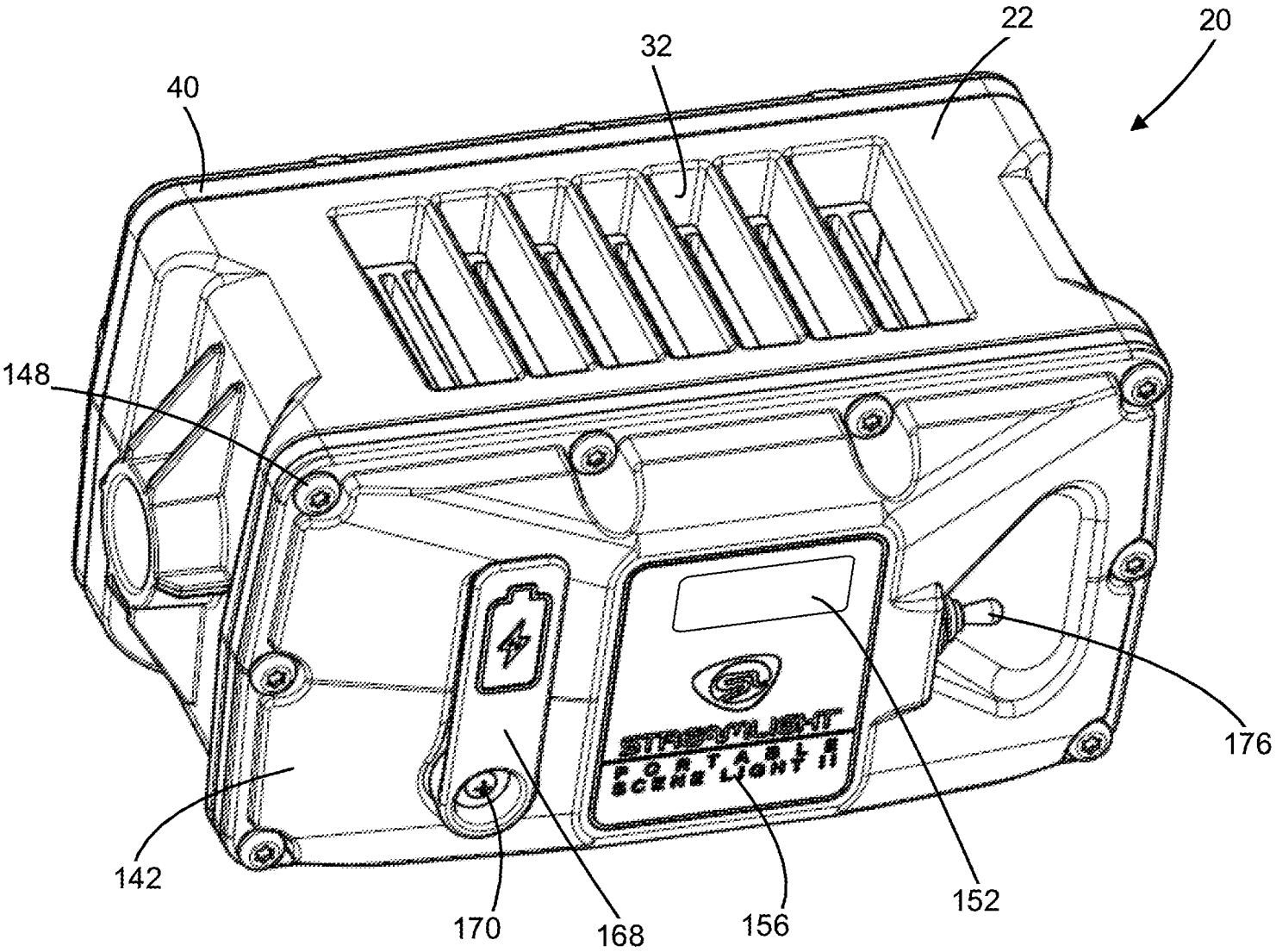
FIG. 6 is a rear perspective view of the light head of the lighting device of FIG. 1.
Figure 7:
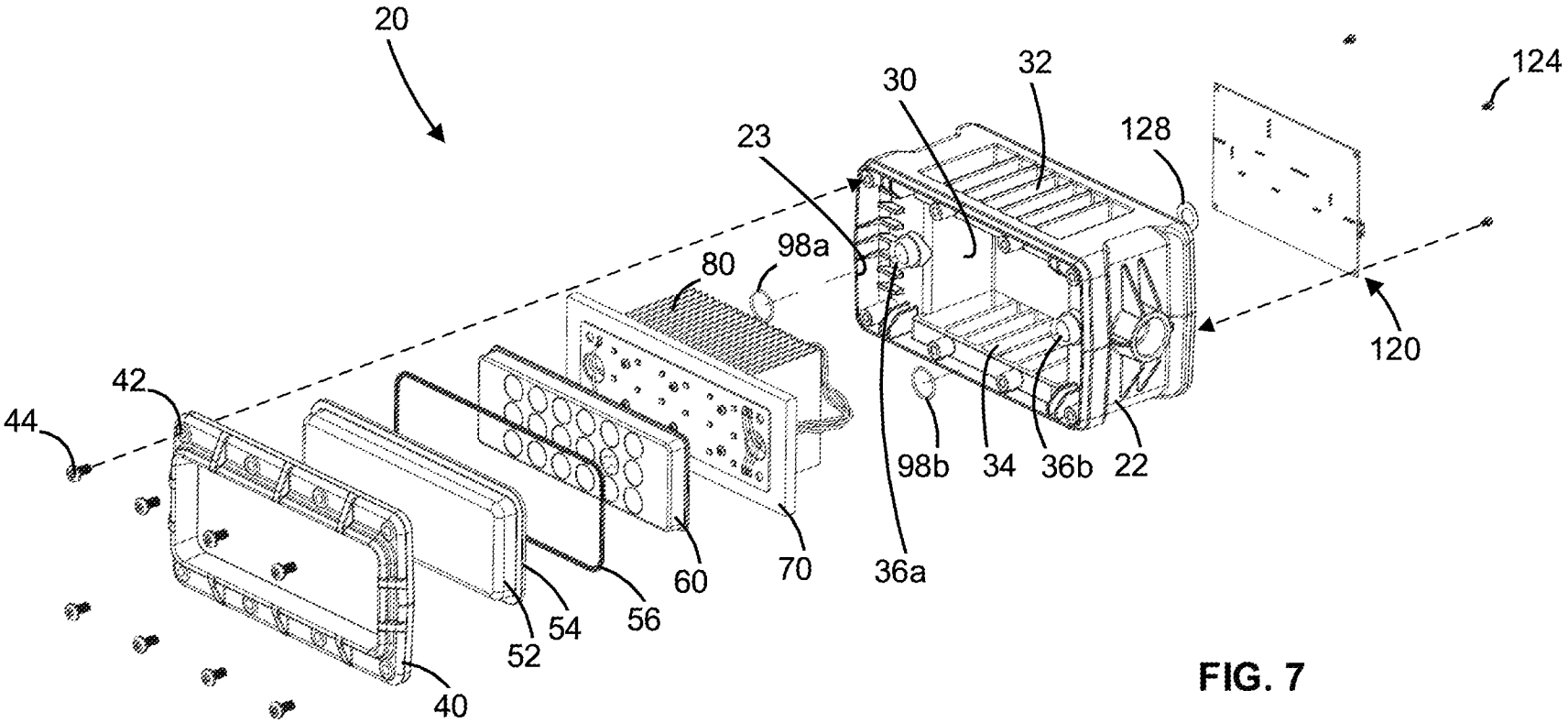
FIG. 7 is a partial exploded view thereof.
Figure 8:
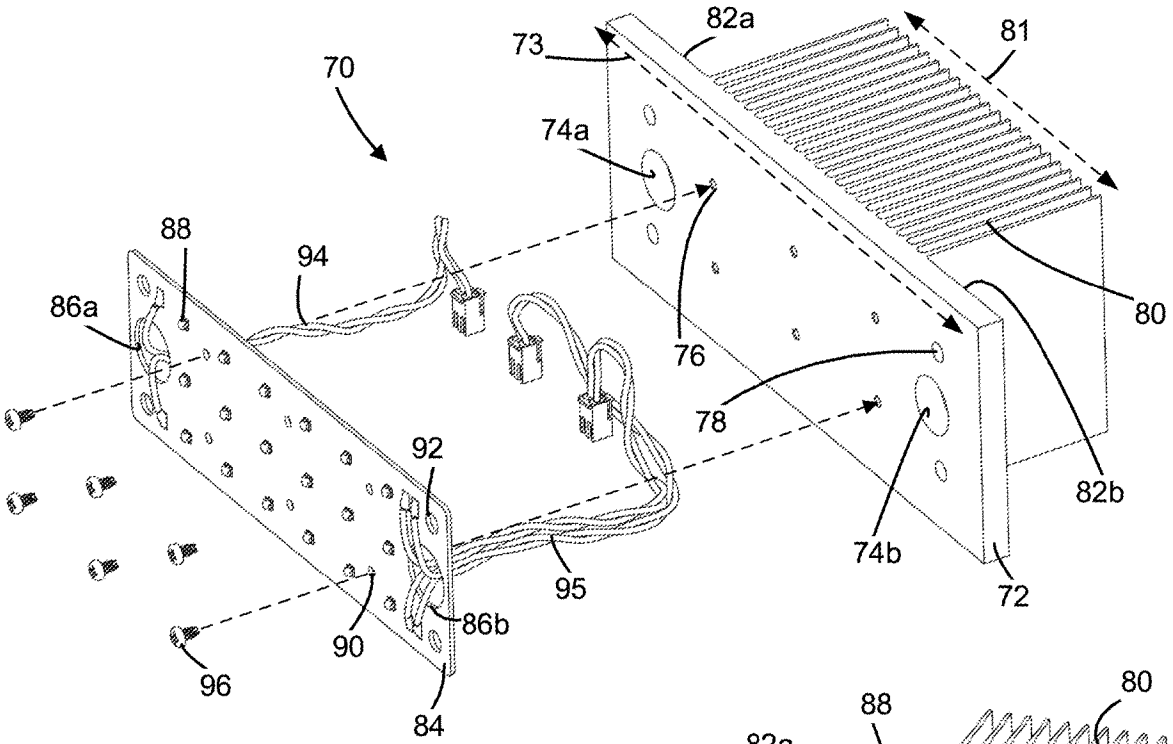
FIG. 8 is an exploded view of a heatsink assembly of the light head of FIG. 2.
Figure 9:
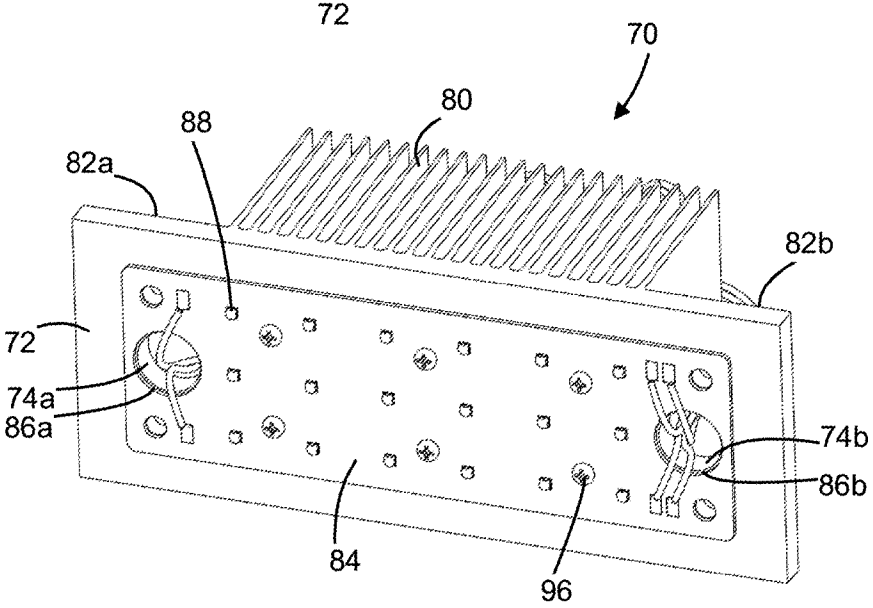
FIG. 9 is a front perspective view of the heatsink assembly of FIG. 8.
Figure 10:
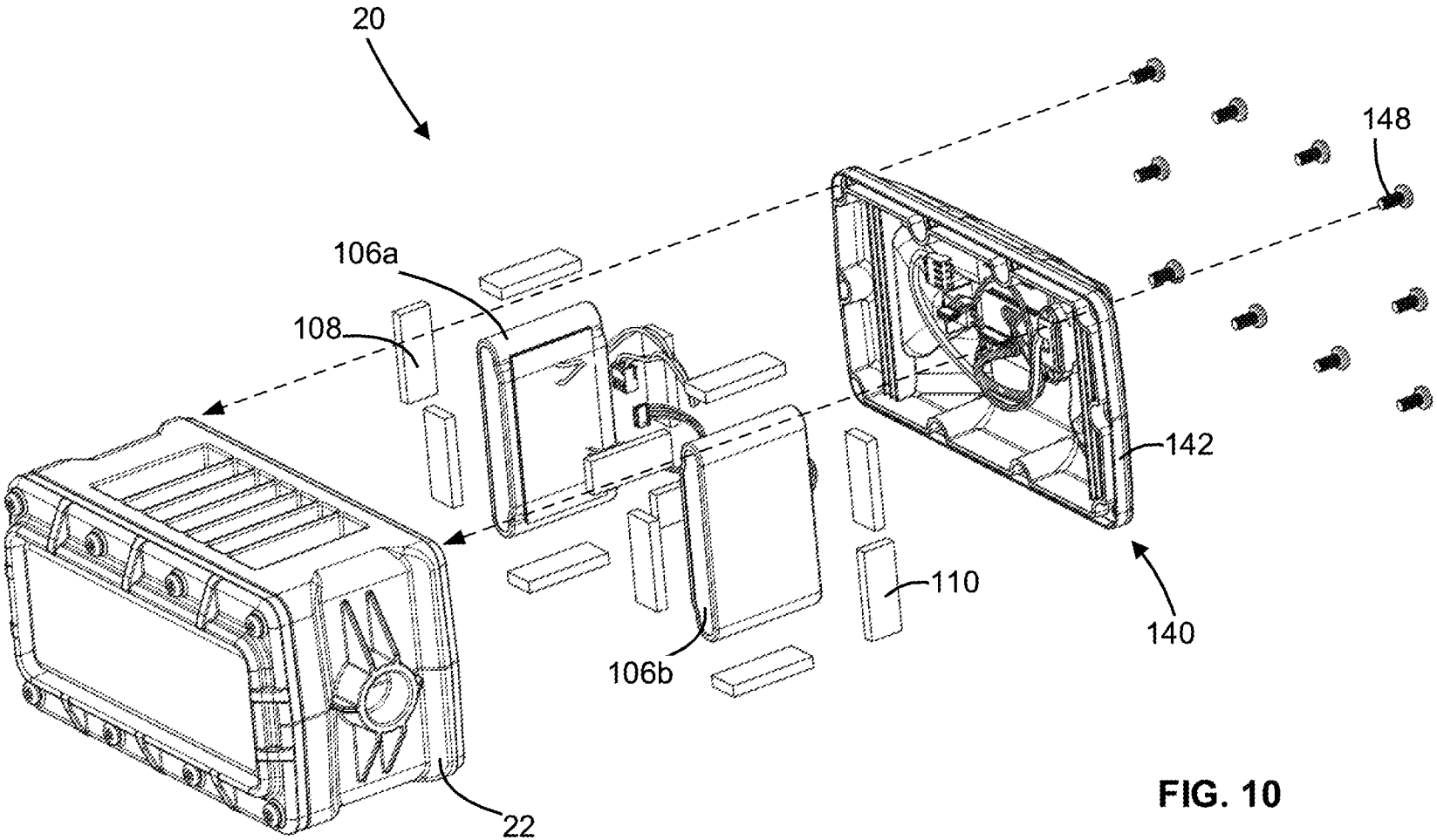
FIG. 10 is a partial exploded view of the light head of FIG. 2, showing the contents of an electronics compartment thereof.
Figure 11:
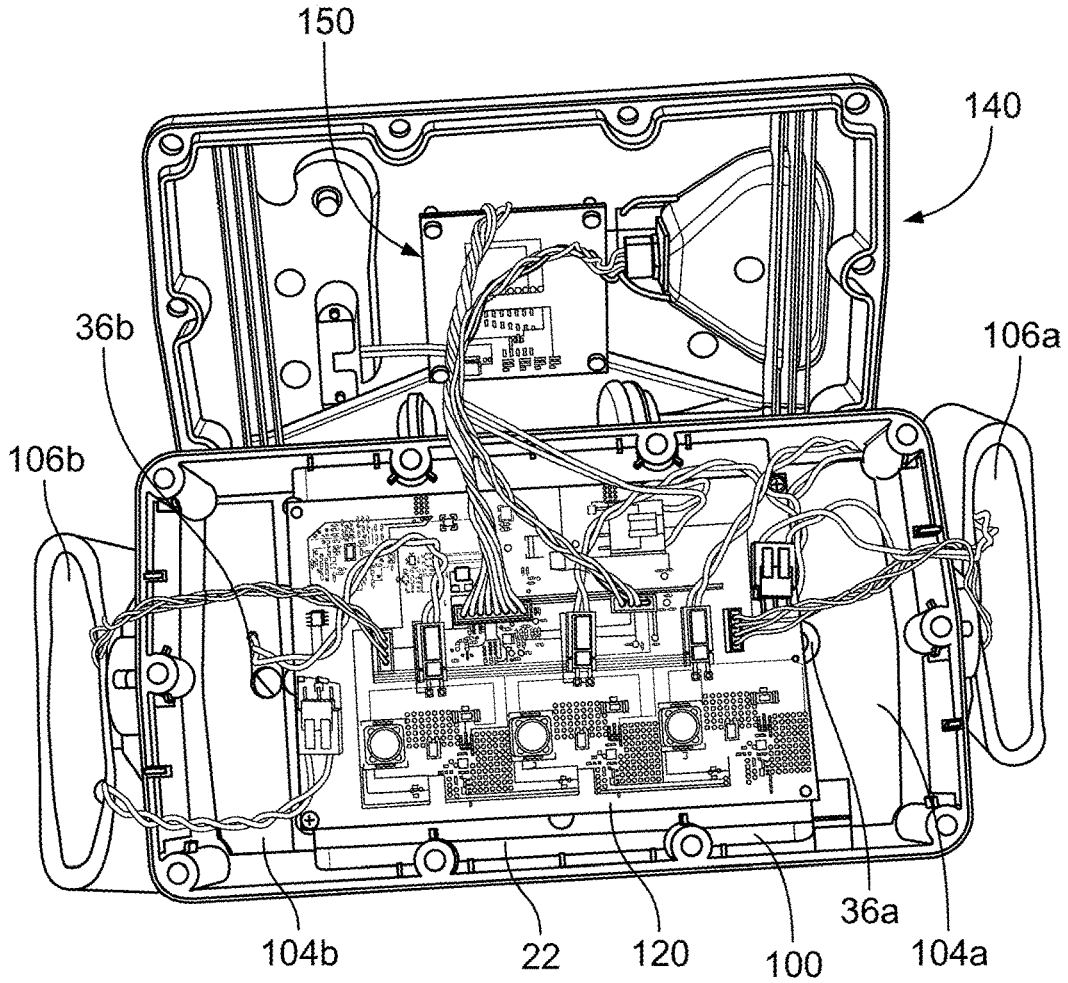
FIG. 11 is a view of an interior and contents of the electronics compartment.
Figure 12:
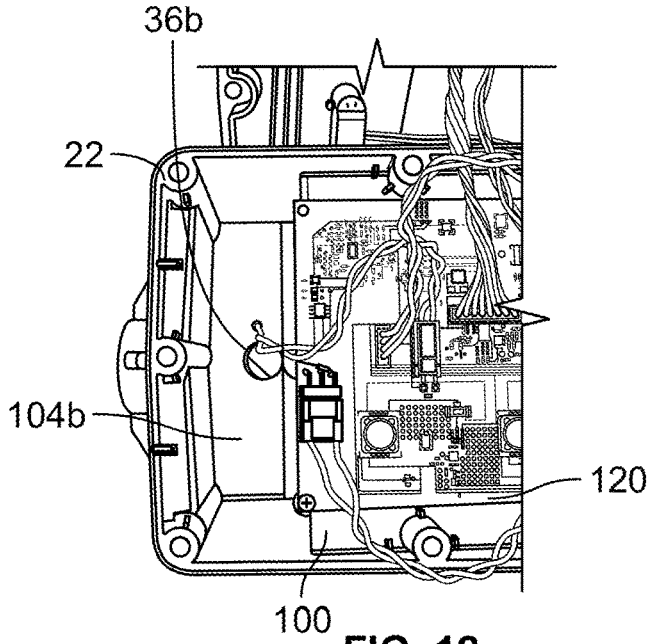
FIG. 12 is a partial view thereof, showing some contents of the electronics compartment.

FIGS. 3-5 show enlarged sectional views of the light head 20 along, respectively, lines 3-3, 4-4, and 5-5 of FIG. 2. As can be seen in these Figures, the lens 52, lens seal 56, and reflector 60 create an LED compartment 50 within the interior of the lens 52, as will be further described below. The reflector 60 has a plurality of openings (in this embodiment eighteen, but only one opening 62 is labeled in the Figures for ease of illustration), each of which corresponds with an individual LED (which also number eighteen in this embodiment, but only LED 88 is labeled in the Figures for ease of illustration) located on an LED board 84 that is attached to the front block 72 of the heatsink assembly 70. The front block 72 of the heatsink assembly 70 includes a plurality of holes 78 (in this embodiment four, but only one hole 78 is labeled in the Figures for ease of illustration) that each receive a respective alignment post (only one post 64 is labeled in the Figures for ease of illustration) located on the rear side of the reflector 60 to align and support the reflector 60 in place adjacent the heatsink assembly 70. It should be understood that any number, array, and type of light source could be provided within the LED compartment 50 in alternative embodiments.

In the present embodiment, the heatsink assembly 70 comprises the front block 72 and a plurality of fins 80 that serve as the heat dissipation means for the heatsink assembly 70. In this embodiment, the heatsink assembly 70 is comprised of extruded aluminum, which has superior heat-dissipation qualities compared to the materials used in the heatsinks of many known prior art lighting devices. In alternative embodiments according to the present disclosure, other materials could be used for the heatsink assembly 70, as would be appreciated by a person having ordinary skill in the relevant art.

In this embodiment, the front block 72 has a width 73 that is substantially the entire width of the opening 23 in the housing 22 into which the heatsink assembly 70 is inserted, but the fins 80 have a width 81 that is less than the width 73 of the front block 72, such that a pair of spaces 82*a*,82*b* are formed behind the front block 72 and adjacent the fins 80. In the location where the fins 80 are located within the housing 22 once the heatsink assembly 70 is installed therein, the heatsink assembly compartment 30 is of reduced width compared to the overall width of the housing 22. This arrangement increases the volume available within the electronics compartment 100, thereby creating a pair of slots 104*a*,104*b* in the electronics compartment 100 into which the battery packs 106*a*,106*b* are fitted. This arrangement also permits the wires that extend between the LEDs and the electronic components to be routed through the heatsink assembly 70, allowing for the heatsink assembly 70 to be included in its own aspirated compartment (e.g., heatsink assembly compartment 30 having vents 32,34) located directly behind the heat-emitting LEDs while remaining compartmentalized from all electronic components, and further permits for all of the electronic components of the light head 20 to be kept interior to the housing 22 and sealed in a waterproof compartment that is separated from the exterior environment.

In this embodiment, the fins 80 of the heatsink assembly 70 are surrounded on four of its six sides by a wall that is waterproof, but the fins 80 of the heatsink assembly 70 are otherwise open to the external environment through the vents 32,34, which are aligned on opposite sides of the housing 22. Thus, depending on the orientation of the housing 22, water or other environmental matter that might enter the heatsink assembly compartment 30 via one of the two vents 32,34 would tend—due to the force of gravity—to exit the housing 22 by the opposite one of the two vents 32,34.

The LED board 84 is mounted to the front block 72 of the heatsink assembly 70 by routing each of a plurality of fasteners (in this embodiment six, but only one fastener 96 is labeled in the Figures for ease of illustration) through a respective fastener hole (only one fastener hole 90 is labeled for ease of illustration) located in the LED board 84 and into a respective fastener hole (only one fastener hole 76 labeled for ease of illustration) located in the front block 72. The LED board 84 also includes a plurality of holes (in this embodiment four, but only one hole 92 labeled in the Figures for ease of illustration) through which the alignment posts (including alignment post 64) of the reflector 60 pass before being inserted into the holes (including hole 78) located in the front block 72.

In this embodiment, a first bundle of wires 94 and a second bundle of wires 95 are each connected to the plurality of LEDs (including LED 88) located on the LED board 84. The LED board 84 includes a pair of holes 86*a*,86*b* and the front block 72 includes a pair of holes 74*a*,74*b*. The housing 22 includes a pair of holes 36*a*,36*b*, each of which includes a mating boss. When the light head 20 is fully assembled, the hole 86*a* in the LED board 84 is aligned adjacent the hole 74*a* in the front block 72, and the mating boss of the opening 36*a* in the housing 22 is at least partially pressed into the hole 74*a* in the front block 72. An O-ring 98*a* is fitted around the mating boss of the opening 36*a* in the housing 22 and—when the light head 20 is assembled—presses against the rear side of the front block 72 of the heatsink assembly 70, thus creating a sealed, waterproof cable passageway through which the first bundle of wires 94 is routed between the front side of the heatsink assembly 70 and the rear side of the heatsink assembly 70, corresponding with a first opening into the electronics compartment 100. In like fashion, when the light head 20 is fully assembled, the hole 86*b* in the LED board 84 is aligned adjacent the hole 74*b* in the front block 72, and the mating boss of the opening 36*b* in the housing 22 is at least partially pressed into the hole 74*b* in the front block 72. An O-ring 98*b* is fitted around the mating boss of the opening 36*b* in the housing 22 and—when the light head 20 is assembled—presses against the rear side of the front block 72 of the heatsink assembly 70, thus creating a sealed, waterproof cable passageway through which the second bundle of wires 95 is routed between the front side of the heatsink assembly 70 and the rear side of the heatsink assembly 70, corresponding with a second opening into the electronics compartment 100.

In this way, the LED compartment 50 and electronics compartment 100 are connected together via the two wire passages located on opposite sides of the fins 80 of the heatsink assembly 70, while remaining in a sealed, waterproof compartment separate from the exterior environment.

FIGS. 10-16 show the various electronic components of the light head 20 located within the electronics compartment 100, including the slots 104*a*,104*b* that accommodate insertion of the battery packs 106*a*,106*b* therein. In this embodiment, a first set of foam blocks (in this embodiment six, but only one foam block 108 is labeled in the Figures for ease of illustration) are respectively located surrounding each side of battery pack 106*a* to protect the battery pack 106*a* from damage, and a second set of foam blocks (in this embodiment six, but only one foam block 110 is labeled in the Figures for ease of illustration) are respectively located surrounding each side of battery pack 106*b* to protect the battery pack 106*b* from damage.

Figure 13:
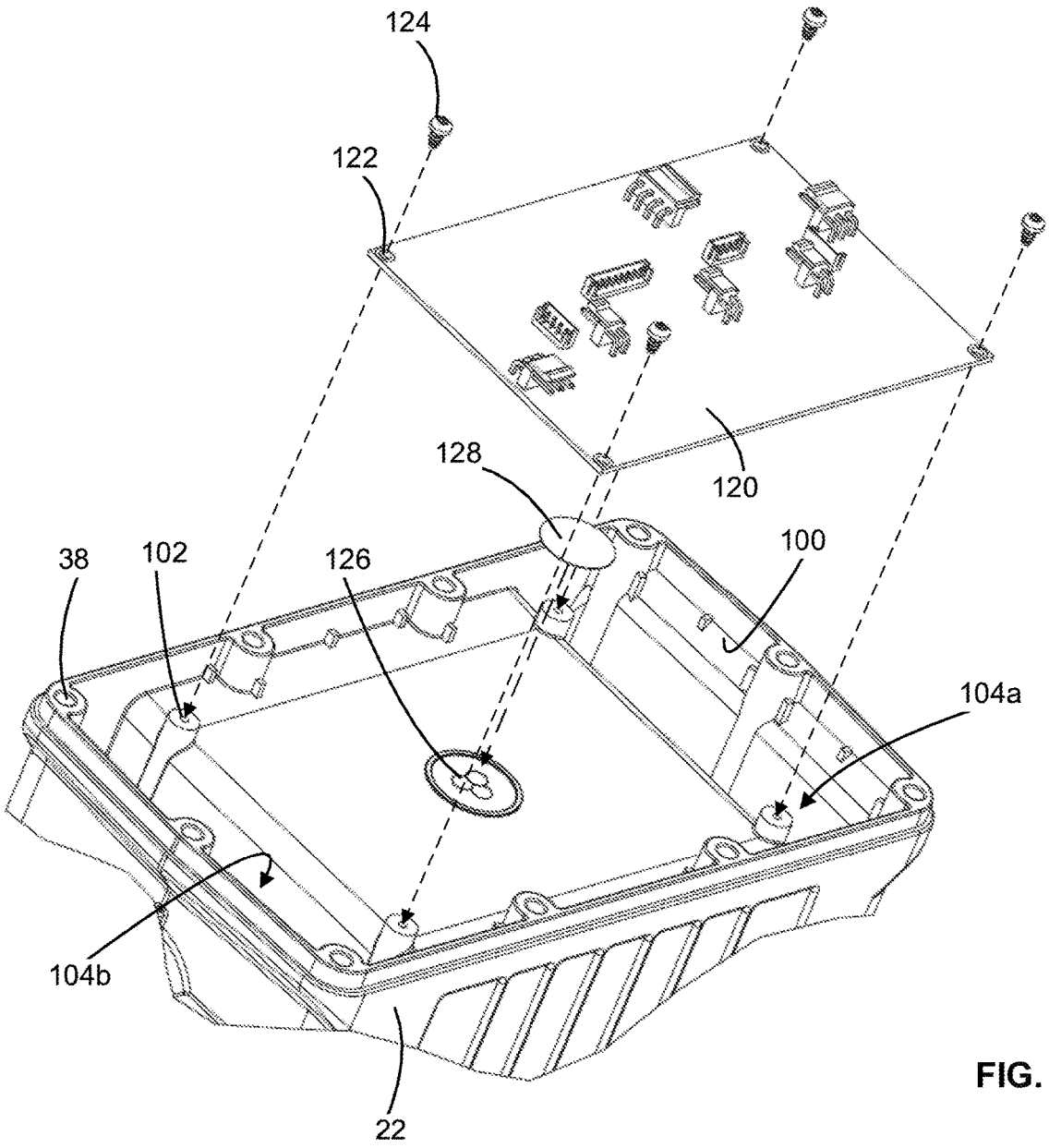
FIG. 13 is a partial exploded view of some contents of the electronics compartment.
Figure 14:
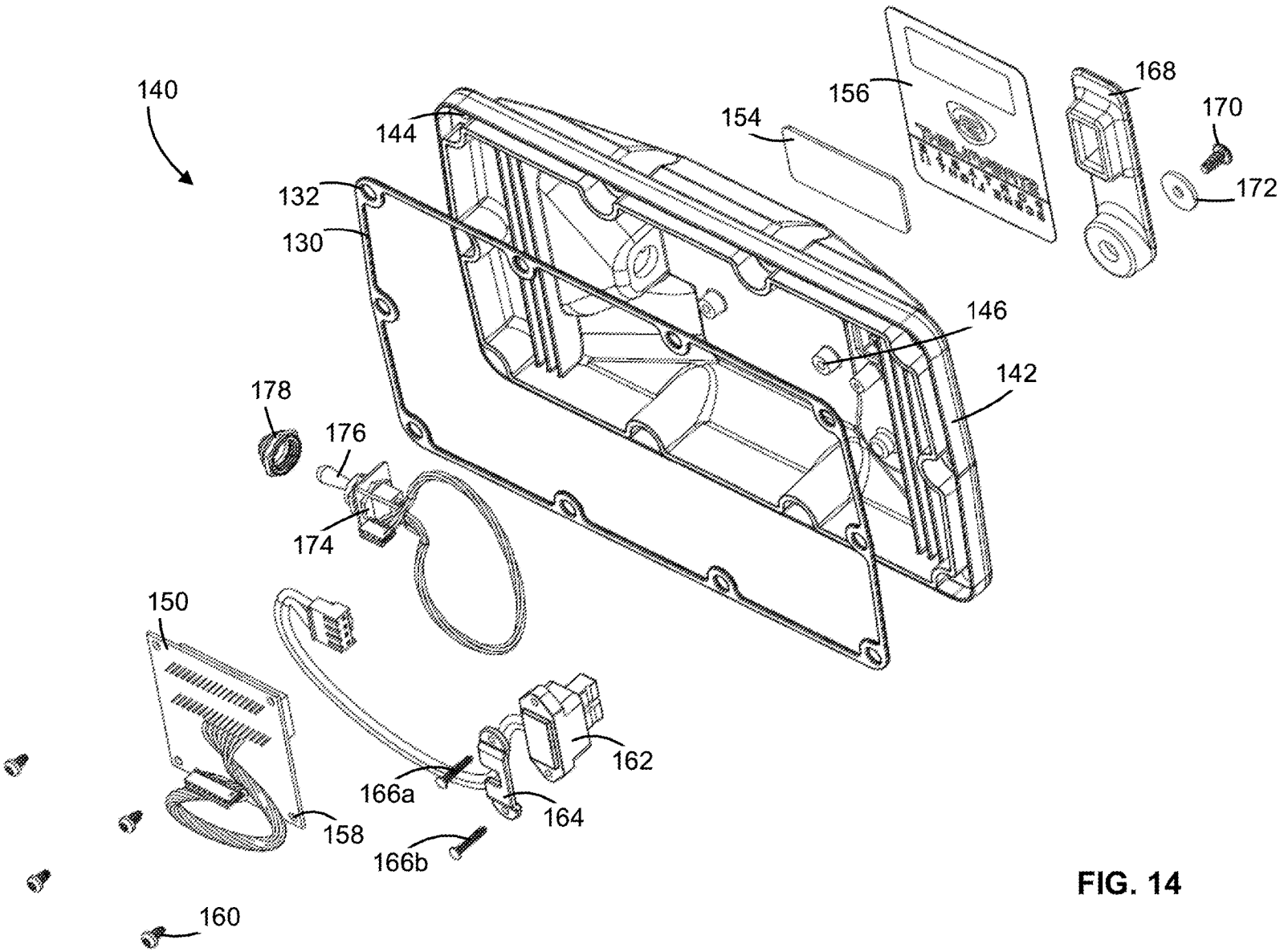
FIG. 14 is an exploded view of a rear cover assembly of the light head of FIG. 2, showing some additional components of the electronics compartment thereof.
Figure 15:
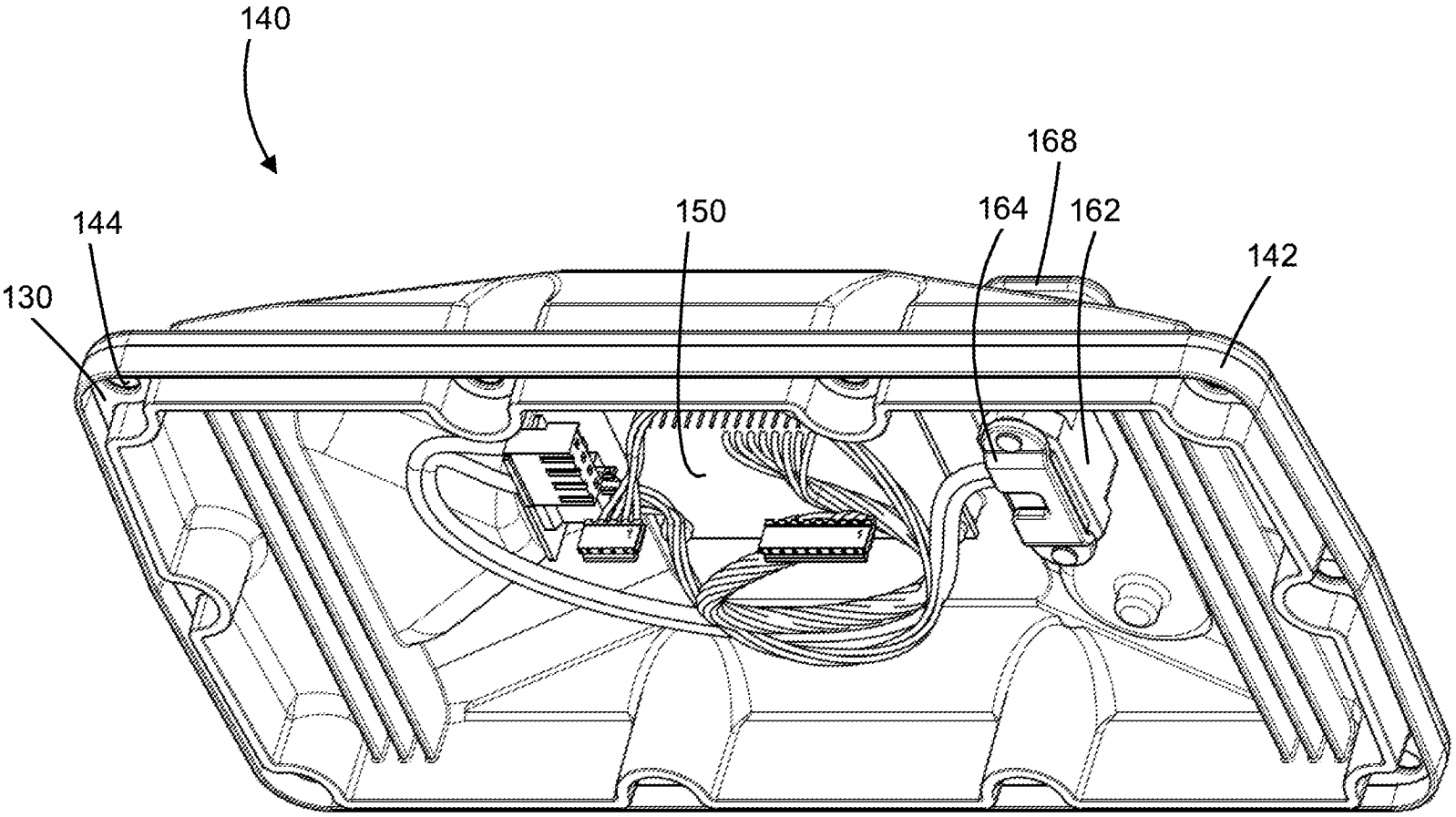
FIG. 15 is a perspective view of the rear cover assembly in an assembled state.
Figure 16:
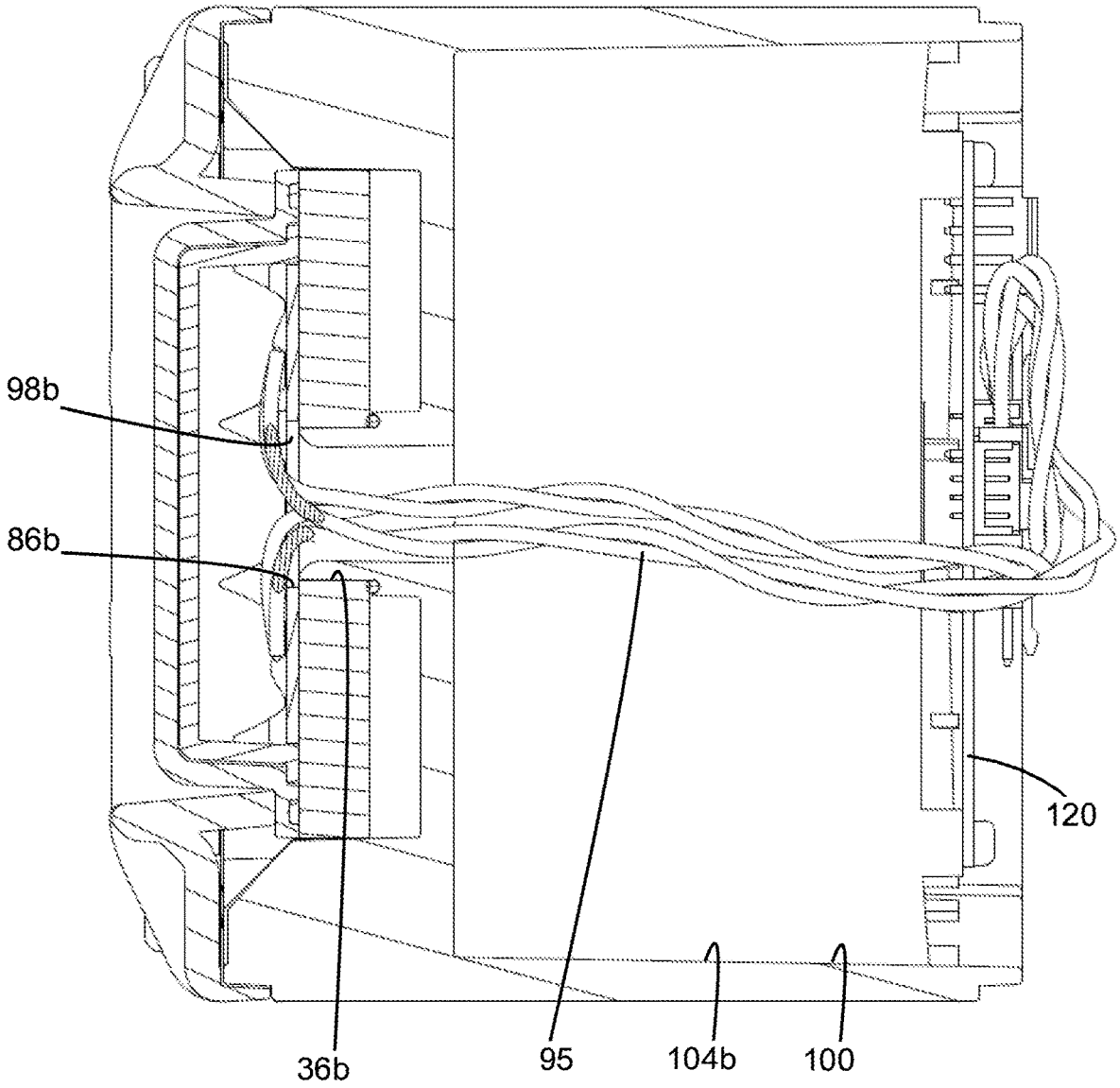
FIG. 16 is an enlarged sectional view taken along 16-16 of FIG. 2, with the rear cover assembly and other components of the electronics compartment removed from view to show the wire routing.

FIG. 13 shows three small holes (though only one hole 126 is labeled) that are routed through the housing 22 between the electronics compartment 100 and the heatsink assembly compartment 30. In this embodiment, a sealing vent 128 is placed over these holes (including hole 126) to maintain the sealed, waterproof environment of the electronics compartment 100 while allowing the electronics compartment 100 to equalize pressure with the external environment without causing damage to the various seals of the electronics compartment 100. In this embodiment, the sealing vent 128 is comprised of an expanded polytetrafluoroethylene (ePTFE) membrane that allows continuous pressure equalization within the electronics compartment 100 while still maintaining an environmental seal therein. W. L. Gore & Associates, Inc. of Newark, Del., United States produces vent seals that are suitable for use as the sealing vent 128. In alternative embodiments, other known or hereafter-discovered membranous materials may be used in place of ePTFE to form the sealing vent 128.

In this embodiment, the LED driver assembly 120 is attached to the housing 22 within the electronics compartment 100 by routing each of a plurality of fasteners (in this embodiment four, but only one fastener 124 is labeled in the Figures for ease of illustration) through a respective fastener hole (only one fastener hole 122 is labeled for ease of illustration) located in the LED driver assembly 120 and into a respective fastener hole (only one fastener hole 102 is labeled for ease of illustration) located on the rear side of the housing 22 within the electronics compartment 100.

A rear cover assembly 140 is attached to the rear side of the housing 22 by routing each of a plurality of fasteners (in this embodiment ten, but only one fastener 148 is labeled in the Figures for ease of illustration) through a respective fastener hole (only one fastener hole 144 is labeled for ease of illustration) located in a rear cover 142 and into a respective fastener hole (only one fastener hole 38 is labeled for ease of illustration) located on the rear side of the housing 22. Like the fastener holes in the housing 22 for attaching the front cover 40, in this embodiment the fastener holes in the housing 22 for attaching the rear cover 142 (which includes fastener hole 38) are of smooth-bore type having a deformable plastic material therein, and the fasteners (including fastener 148) are of thread-forming type so that each of the fasteners (including fastener 148) forms its own threads within the respective hole when advanced therein. A rear seal 130 having a corresponding set of fastener holes (only one fastener hole 132 is labeled in the Figures for ease of illustration) is press-fit within a corresponding perimetral space located within the rear cover 142, and when the rear cover 142 is affixed to the housing 22 the rear seal 130 creates a waterproof seal with the housing 22.

In this embodiment, the light head 20 also comprises a display assembly 150 that provides the user with a runtime countdown that informs the user of the amount of runtime remaining before the light head 20 will need to be recharged. The display assembly 150 comprises a PCB including a display 152 connected thereto, a protective lens 154 that overlays the display, and a label 156 overlaying the protective lens, the label 156 also acting as a seal that maintains the sealed, waterproof environment of the electronics compartment 100. In alternative embodiments, the label 156 may exclude any text or images. Turning back to the present embodiment, the display assembly 150 is attached to the interior side of the rear cover 142 by routing each of a plurality of fasteners (in this embodiment four, but only one fastener 160 is labeled in the Figures for ease of illustration) through a respective fastener hole (only one fastener hole 158 is labeled for ease of illustration) located in the display assembly 150 and into a respective threaded boss (only one boss 146 is labeled for ease of illustration) formed in the rear cover 142.

Because the light head 20 of this embodiment is powered by rechargeable battery packs 106*a*,106*b*, the light head 20 further comprises a charge plug assembly 162 located within the electronics compartment 100. The charge plug assembly 162 is held in place on the rear cover 142 by a charge port strap 164 that is affixed to the rear cover 142 by a pair of fasteners 166*a*,166*b*. The charge plug assembly 162 is designed with a waterproof seal with respect to the exterior of the rear cover 142, but a charge port cover 168 is also provided to keep the charge contacts free of debris. The charge port cover 168 is held in place on the exterior side of the rear cover 142 by a fastener 170 and washer 172. Finally, the electronics compartment 100 includes a switch assembly 174 that allows the user to toggle the light head 20 on and off (and optionally between various lighting modes), the switch assembly 174 comprising a switch 176 that extends through the rear cover 142 and a boot 178 that surrounds the switch 176 where it exits the rear cover 142 to maintain the waterproof seal of the electronics compartment 100.

In alternative embodiments of the light head 20 according to the present disclosure, the waterproof seals could be replaced with seals that create a hermetic (i.e., non-gas-permeable) environment within the LED compartment 30 and/or electronics compartment 100.

Although exemplary implementations of the herein described systems and methods have been described in detail above, those skilled in the art will readily appreciate that many additional modifications are possible in the exemplary embodiments without materially departing from the novel teachings and advantages of the herein described systems and methods. Accordingly, these and all such modifications are intended to be included within the scope of the herein described systems and methods. The herein described systems and methods may be better defined by the following exemplary claims.

What is claimed is:

1. A lighting device comprising:

a heatsink located in a heatsink compartment, the heatsink including a block extending laterally at a front side of the heatsink and a plurality of fins extending from the block toward a rear side of the heatsink, the heatsink compartment being aspirated;

a lens coupled to the block of the heatsink;

at least one light coupled to the block of the heatsink and located in a first compartment defined between the lens and the block of the heatsink, the first compartment being waterproof; and at least one power source operably connected to the at least one light to supply power thereto, the at least one power source located in a second compartment, the second compartment being waterproof;

the heatsink compartment being external to each of the first compartment and the second compartment wherein the heatsink is located and located at least partially between the first and second compartment and located at least partially between the first and second compartments;

wherein the first and second compartments are connected together through the block of the heatsink around laterally opposing sides of the plurality of fins of the heatsink to form a continuous, waterproof compartment.

2. The lighting device of claim 1, further comprising at least one hole located through a wall of the second compartment and at least one seal covering the at least one hole, the at least one seal being gas-permeable but impermeable to liquids.

3. The lighting device of claim 2, wherein the heatsink compartment is in fluid flow communication with an exterior of the housing.

4. The lighting device of claim 3, wherein the heatsink compartment includes a first vent and a second vent located therein, the first and second vents being located on two additional opposing sides of the heatsink to provide fluid flow communication with the heatsink and the exterior of the housing.

5. The lighting device of claim 1, wherein the at least one light, at least one power source, and heatsink are located within a housing, the lighting device further comprising a frame to which the housing is attached.

6. The lighting device of claim 5, wherein the housing is rotatably attached to the frame.

7. The lighting device of claim 5, wherein the housing includes a first vent and a second vent located therein, the first and second vents being located on opposing sides of the heatsink and in fluid flow communication with the heatsink and an exterior of the housing.

8. A lighting device comprising a housing, the housing including:

a heatsink compartment containing at least one heatsink, the at least one heatsink having six sides including a front side and a rear side, wherein the heatsink includes a block extending laterally at the front side of the heat sink and a plurality of fins extending from the block toward the rear side of the heatsink;

a lens coupled to the block of the heatsink;

at least one light coupled to the block of the heatsink and located in a light compartment defined between the lens and the block of the heatsink, the light compartment being waterproof; and at least one power source operably connected to the at least one light to supply power thereto and located in an additional compartment that is separate from the heatsink compartment, the additional compartment containing the at least one power source and being waterproof;

wherein the heatsink compartment is located at least partially between the at least one light and the additional compartment, wherein the heatsink compartment completely envelopes the at least one heatsink on at least four of its six sides, and wherein the light compartment and the additional compartment are connected together through the block of the heatsink around laterally opposing sides of the plurality of fins of the heatsink to form a continuous, waterproof compartment.

9. The lighting device of claim 8, wherein the at least one light is operably connected to the at least one power source through a passageway within the block of the at least one heatsink.

10. The lighting device of claim 8, wherein the at least one light is operably connected to the at least one power source around at least one side of the laterally opposing sides of the plurality of fins of the heatsink.

11. The lighting device of claim 10, wherein the at least one light is operably connected to the at least one power source around each of the laterally opposing sides of the plurality of fins of the heatsink.

* * * * *